United States Patent [19]

Coles

[11] 4,103,655

[45] Aug. 1, 1978

[54] INTERNAL COMBUSTION ENGINE

[76] Inventor: Donald Kennedy Coles, 2505 Capitol Ave., Fort Wayne, Ind. 46806

[21] Appl. No.: 780,172

[22] Filed: Mar. 22, 1977

[51] Int. Cl.[2] ..... F02B 3/00

[52] U.S. Cl. ..... 123/119 B; 123/32 EA

[58] Field of Search ..... 123/198 F, 97 B, 32 EA, 123/119 B, 32 EL, 102, 198 DB, 41.86

[56] References Cited

U.S. PATENT DOCUMENTS

| | | | |
|---|---|---|---|
| 3,570,460 | 3/1961 | Rabus | 123/97 B |
| 3,756,205 | 9/1973 | Frost | 123/32 EA |
| 4,040,395 | 8/1977 | Demetrescu | 123/32 EA |
| 4,068,628 | 1/1978 | Duckworth | 123/119 B |

*Primary Examiner*—Charles J. Myhre
*Assistant Examiner*—R. A. Nelli

[57] ABSTRACT

A fuel injection apparatus for a multicylinder gasoline engine controls average engine output torque by omitting fuel from a proportion of the cylinder cycles. This system eliminates the need to heavily throttle the air intake, thus easing engine design and allowing the engine to be operated near its throttle point of peak efficiency. The engine has an electrically actuated fuel injector valve for each cylinder; skipping of fuel rations is controlled electronically.

In order to reduce atmospheric pollution, a special cylinder is exempted from inhibition of its fuel rations in order that it may be used to completely reburn the blowby gases from the other cylinders.

During powered operation, blowby gases from all cylinders accumulate in the crankcase. When the engine power is to be shut off, inhibition of fuel rations to the special cylinder is delayed in order to give it time to reburn the accumulated pollutants in the crankcase.

2 Claims, 31 Drawing Figures

FIG. 1
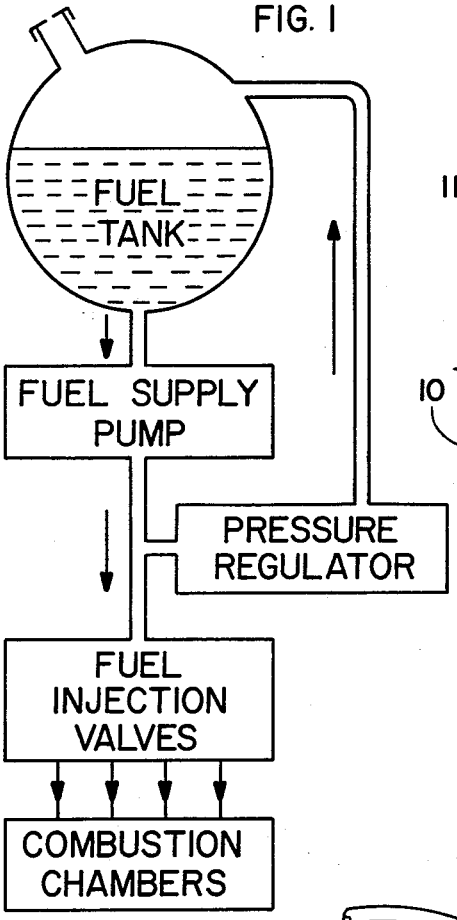
FIG. 2
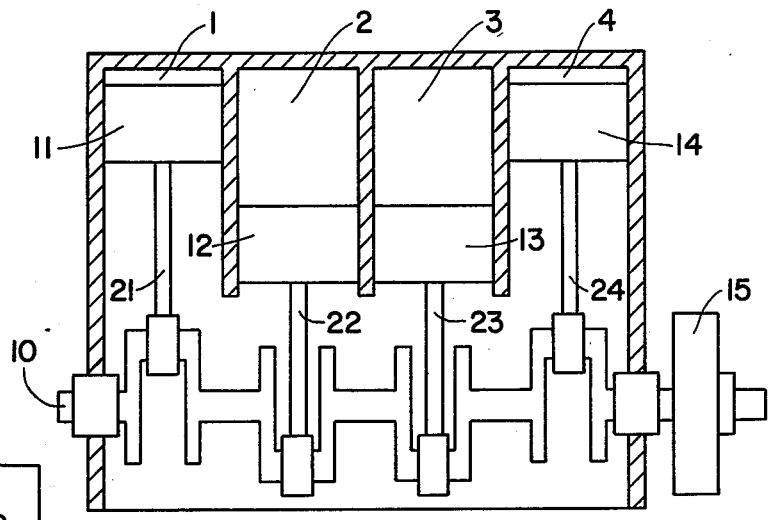
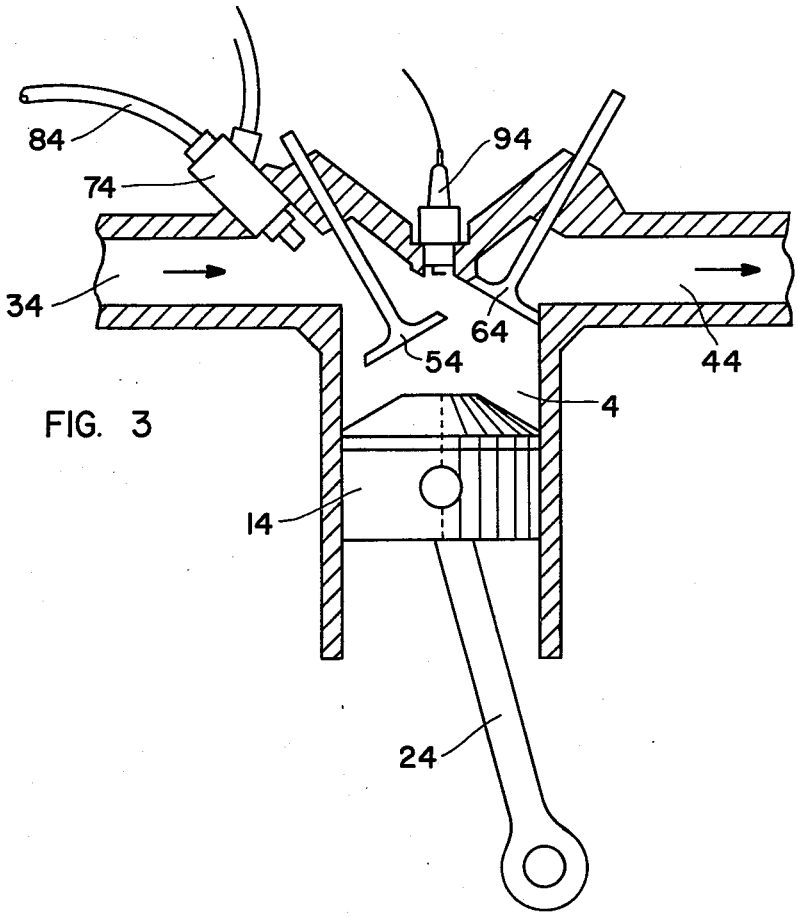
FIG. 3

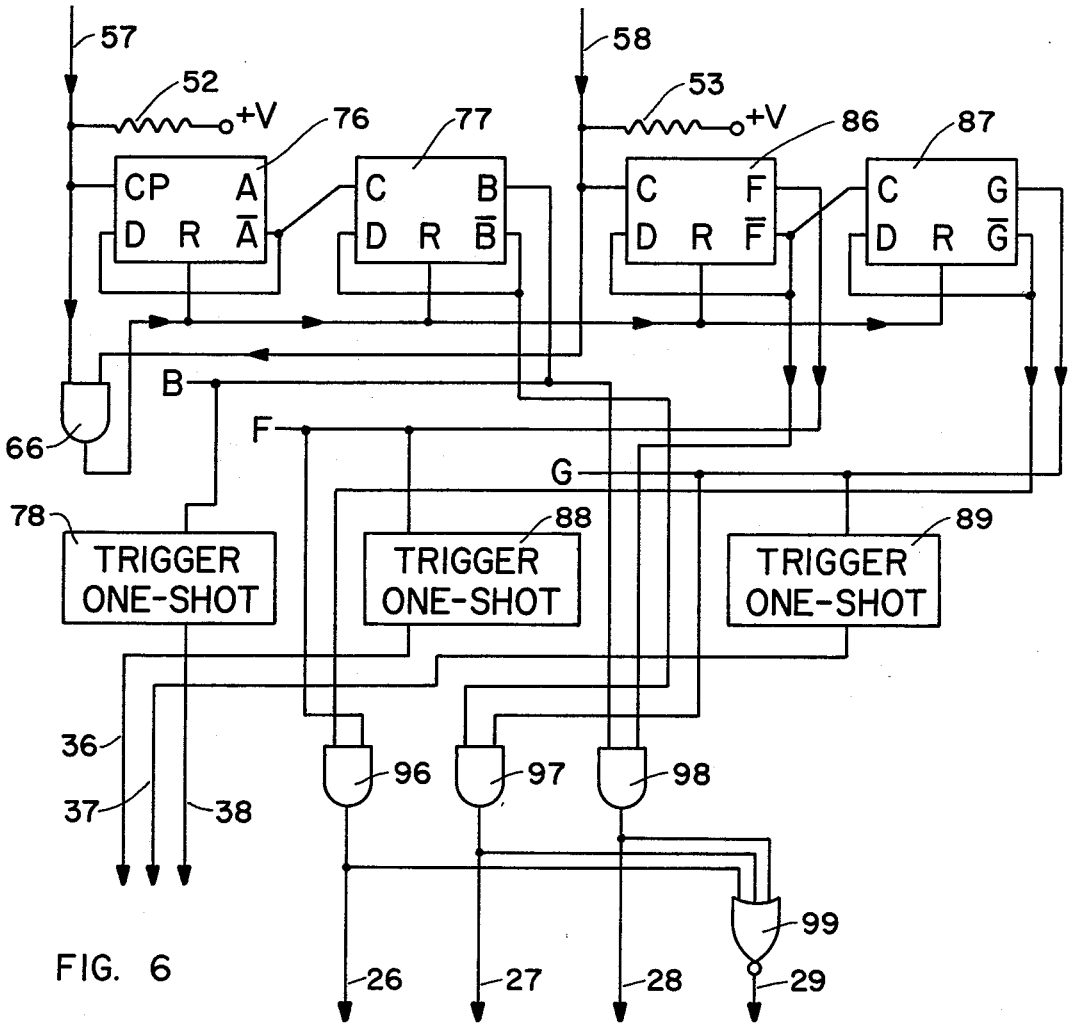
FIG. 6
FIG. 7
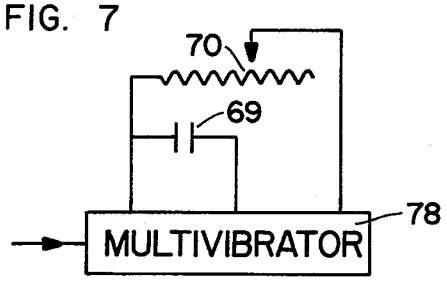

FIG. 15
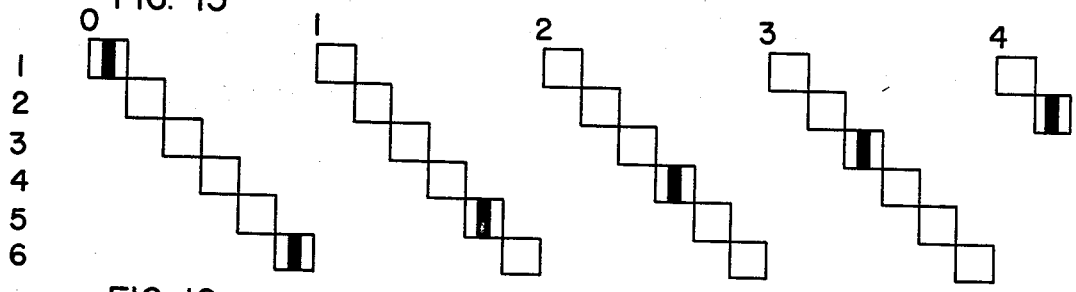
FIG. 16
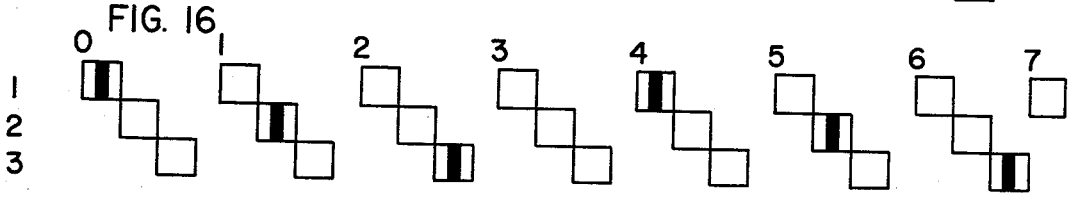
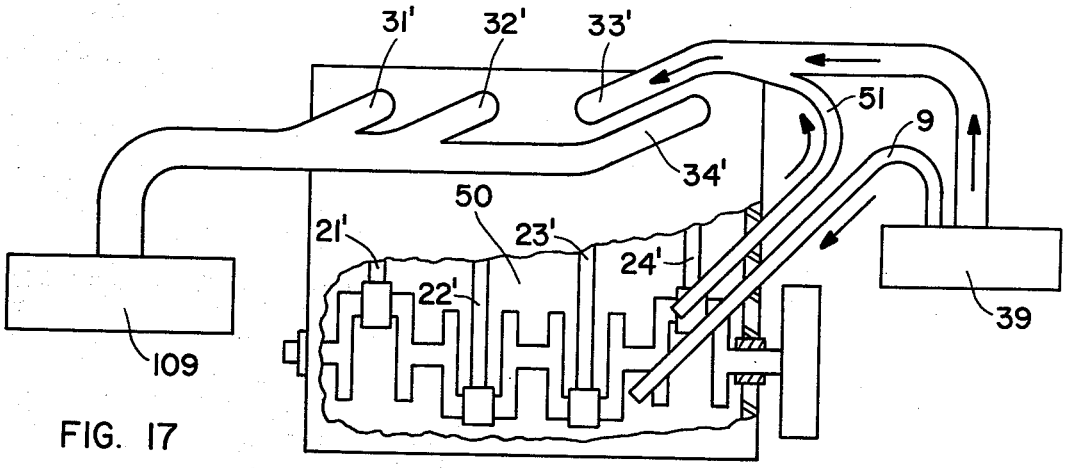
FIG. 17
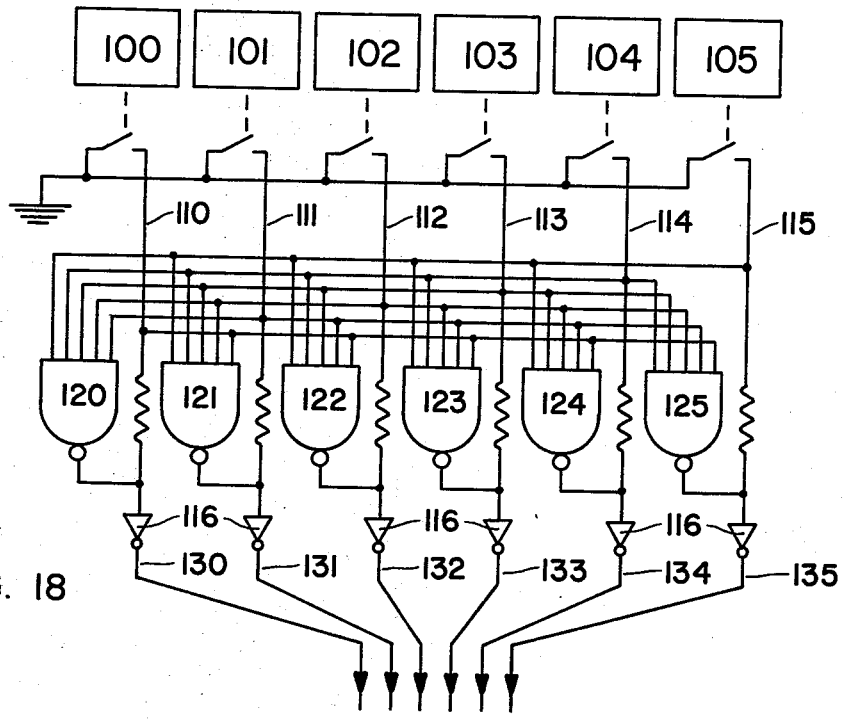
FIG. 18

| PUSH-BUTTON | CONTROL STATE | COUNT 0 | 1 | 2 | 3 | BOOLEAN SYMBOL | ENABLED FRACTION |
|---|---|---|---|---|---|---|---|
| 101 | 1 | 0 | 0 | 0 | 0 | 0 | .25 |
| 102 | 2 | 0 | 0 | 0 | 1 | A·B | .4375 |
| 103 | 3 | 0 | 1 | 0 | 1 | A | .625 |
| 104 | 4 | 0 | 1 | 1 | 1 | A+B | .8125 |
| 105 | 5 | 1 | 1 | 1 | 1 | 1 | 1.0 |

| CONTROL COUNT | INHIBITOR COUNT 0 | 1 | 2 | 3 | 4 | 5 | 6 | 7 | BOOLEAN SYMBOL | ENABLED FRACTION |
|---|---|---|---|---|---|---|---|---|---|---|
| 0 | 0 | 0 | 0 | 0 | 0 | 0 | 0 | 0 | 0 | .25 |
| 1 | 0 | 0 | 0 | 0 | 0 | 0 | 0 | 1 | A·B·C | .3437 |
| 2 | 0 | 0 | 0 | 1 | 0 | 0 | 0 | 1 | A·B | .4375 |
| 3 | 0 | 0 | 0 | 1 | 0 | 1 | 0 | 1 | A·(B+C) | .5312 |
| 4 | 0 | 1 | 0 | 1 | 0 | 1 | 0 | 1 | A | .625 |
| 5 | 0 | 1 | 0 | 1 | 0 | 1 | 1 | 1 | A+B·C | .7187 |
| 6 | 0 | 1 | 1 | 1 | 0 | 1 | 1 | 1 | A+B | .8125 |
| 7 | 0 | 1 | 1 | 1 | 1 | 1 | 1 | 1 | A+B+C | .9062 |
| 8 | 1 | 1 | 1 | 1 | 1 | 1 | 1 | 1 | 1 | 1.0 |

INTERNAL COMBUSTION ENGINE

BACKGROUND OF THE INVENTION

1. Field of the Invention

Fuel injection apparatus for an internal combustion piston engine varies the engine output torque by controlling the average fraction of the combustion chamber cycles which receive fuel injection.

2. Prior Art

Gasoline engines generally require some means of controlling their torque output, since the maximum available torque is not always wanted. Conventional gasoline engines have a throttle valve in the air inlet duct which serves as the primary control of engine output torque. The air intake pressure is then sensed and used in adjusting the fuel intake, so that the fuel-air ratio is reasonably close to its optimum value for engine efficiency and low atmospheric pollution. Exact timing of the spark ignition, for good engine efficiency and low atmospheric pollution, is also made to depend on the air intake pressure.

In some multicylinder engines, equal distribution of fuel to the different cylinders is effected by providing a separate fuel injector valve for each cylinder. Fuel is injected during each air intake stroke of each cylinder, the amount of fuel being commonly adjusted automatically in dependence on air intake pressure and other factors. Automatic fuel injection apparatus for this purpose are disclosed, for example, in U.S. Pat. Nos. 3,612,008; 3,612,009; 3,612,010; 3,945,350; 3,983,849 and 3,612,013. The last of these patents discloses a deceleration override circuit which responds to strong throttling of the engine. At engine speeds above idle speeds, the override circuit disables or inhibits the regular fuel injection circuit in order to save fuel and reduce atmospheric pollution.

New gasoline engine design is made difficult by heavy throttling of the air intake, since it affects the amount of fuel needed, vaporization and mixing of the fuel, firing or misfiring, flame propagation, heat transport to the wall, deposition of carbon, detonation, exhaust gas pressure, exhaust gas recirculation, piston blowby, crankcase ventilation, and atmospheric pollution. In developing a new engine, so much experimentation and compromise must be carried out that development of a satisfactory engine may take years.

In my copending U.S. Pat. application no. 735,392, filed 10-26-76, a method of torque control is disclosed which eliminates the need to heavily throttle the air intake. In the preferred embodiment, the average torque output of a single cylinder engine is reduced by inhibiting fuel injection in a fraction of the cylinder cycles. The fraction of fuel rations skipped is varied manually through the intervention of an electronic fuel injection inhibitor. In another embodiment, the fraction of skipped fuel rations is controlled automatically in dependence on engine speed and external load.

Any multicylinder engine with fuel injection needs some means of distributing potential fuel injection pulses to the proper cylinder, so that fuel will be introduced into each cylinder in the proper part of its cycle. An additional requirement for my inhibited engine is a means for distributing the inhibition of injections fairly evenly over the different cylinders.

The injection inhibitor apparatus for a multicylinder engine may simply consist of duplicates of my single cylinder injection inhibitor apparatus, but in such an aggregation the inhibition can be distributed unevenly among the cylinders.

Methods of engine torque control which eliminate the need to heavily throttle the air intake are disclosed in U.S. Pat. Nos. 3,756,205 and 4,040,395. These methods reduce engine output torque by inhibiting the ration of fuel in a fraction of the combustion chamber cycles. Such engines tend to pollute the atmosphere, however, because cylinders that are partially inhibited cannot be used to completely reburn the blowby gases which leak past the pistons into the crankcase.

SUMMARY OF THE INVENTION

Fuel injection apparatus for a multicylinder gasoline engine varies the average engine output torque by omitting fuel injection from some of the cylinder cycles. Thus the inlet air flow need not be so heavily throttled and the engine may be operated near its throttle point of peak efficiency.

In order to reduce atmospheric pollution, a special cylinder has its air inlet valve connected to the crankcase so that it can reburn all of the accumulated blowby gases from all cylinders.

When the ordinary cylinders have their fuel rations partially inhibited, the special cylinder continues to receive all of its fuel rations, in order that it can continue to reburn all of the blowby gases.

When the engine power is to be completely shut down, fuel rations to the ordinary cylinders are first completely inhibited, while the special cylinder continues to receive all of its fuel rations for a short interval of time. The delay gives the special cylinder time to reburn the accumulated pollutants from the other cylinders. Then the special cylinder can also be disabled.

BRIEF DESCRIPTIONS OF THE DRAWINGS

FIG. 1 is a diagram of the fuel supply system for my engine.

FIG. 2 shows a side view of my engine.

FIG. 3 shows a combustion chamber in my engine.

FIG. 6 is a wiring diagram of the fuel injection distributor in the preferred embodiment.

FIG. 7 shows timing elements for the fuel rationing one-shot.

FIG. 9 diagrams the fuel injection inhibitor.

Figure 10:
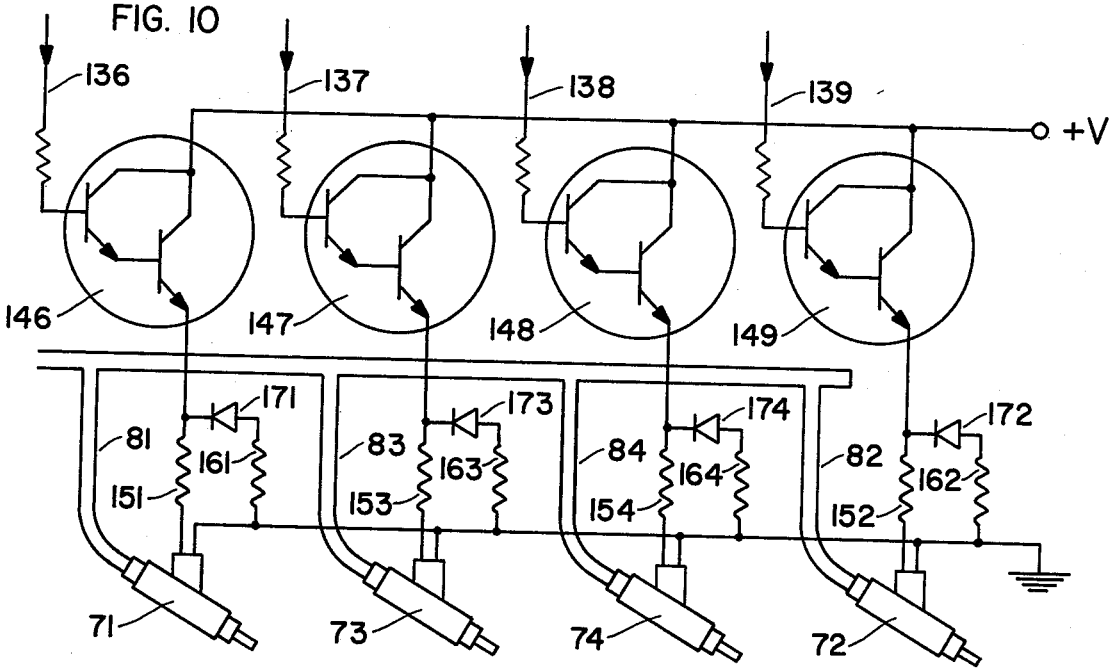

FIG. 10 shows the power amplifiers and fuel injection valves.

Figure 11:
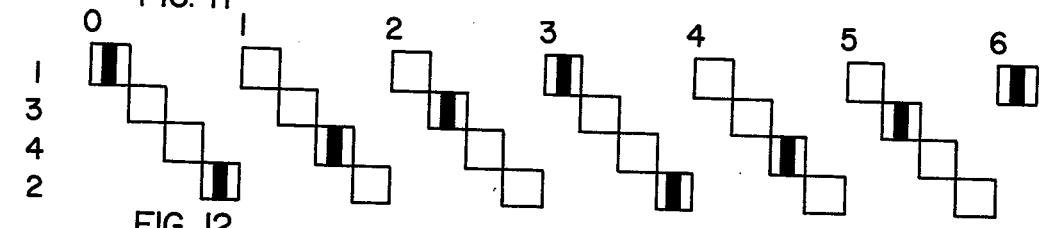
Figure 12:
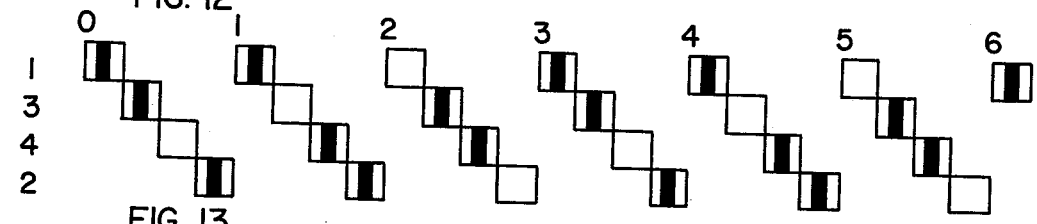

FIGS. 11, 12 show timing of enabled and inhibited cycles for the preferred embodiment.

Figure 13:
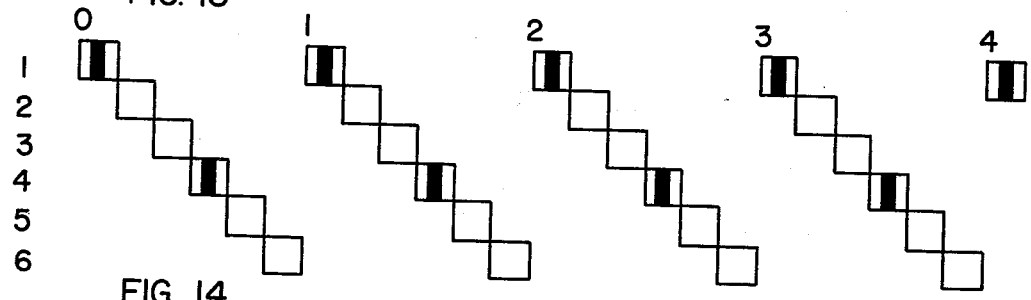
Figure 14:
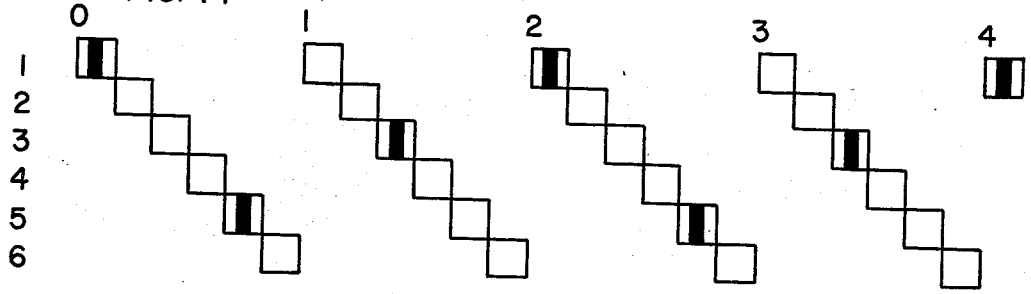

FIGS. 13, 14, 15 show possible timing for a six cylinder engine. FIG. 16 shows possible timing for a three cylinder engine.

FIG. 17 is a side view of the engine in a second embodiment.

FIG. 18 diagrams the manual control for the second embodiment.

Figure 19:
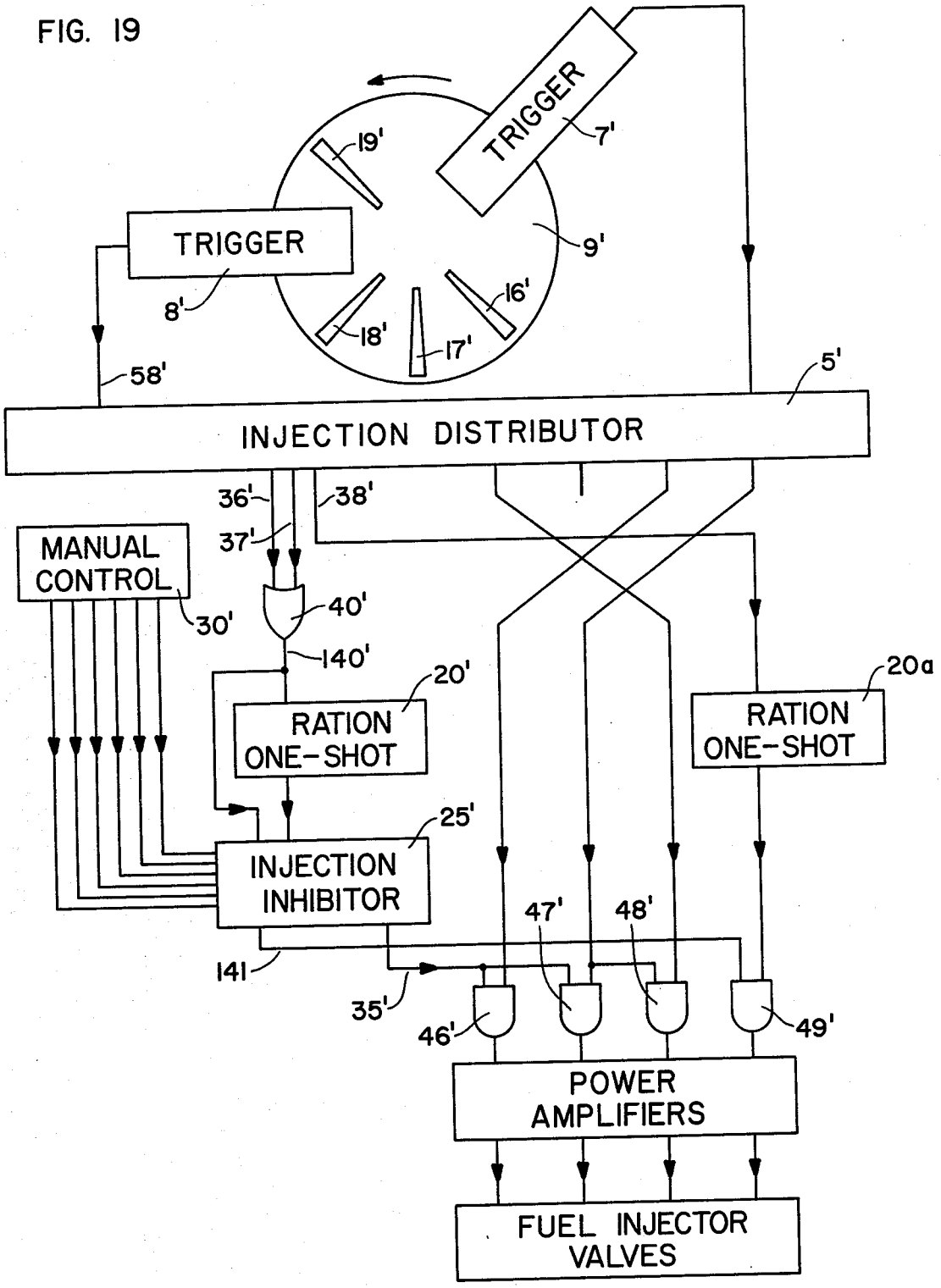

FIG. 19 is a block diagram for the second embodiment.

Figure 20:
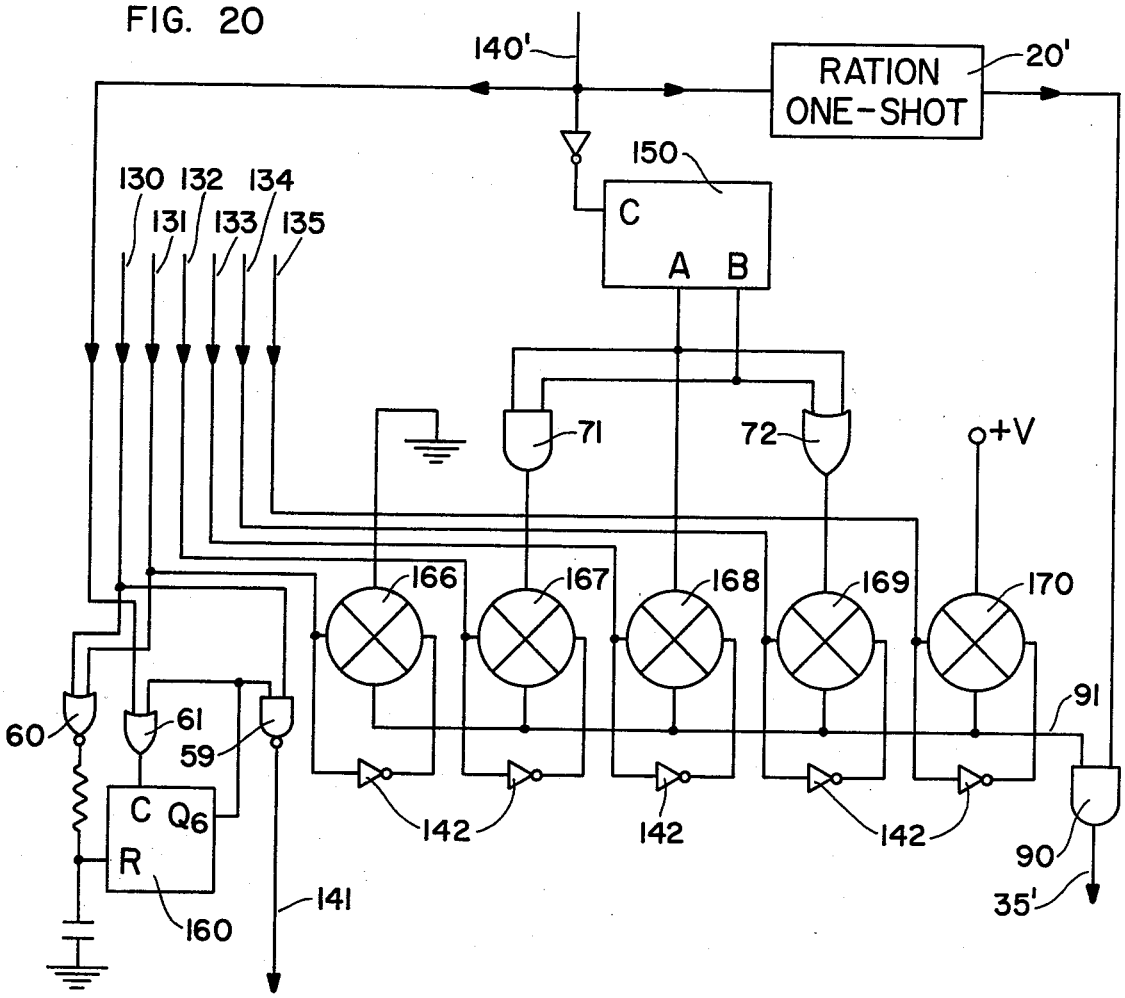

FIG. 20 shows the injection inhibitor for the second embodiment.

Figure 21:
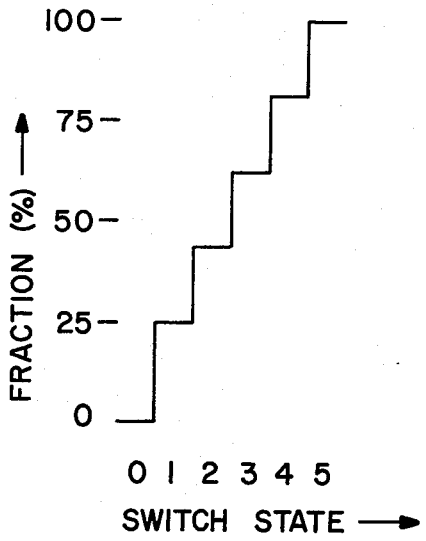

FIG. 21 shows the fractional engine output torque for different manual control states of the second embodiment.

Figure 22:
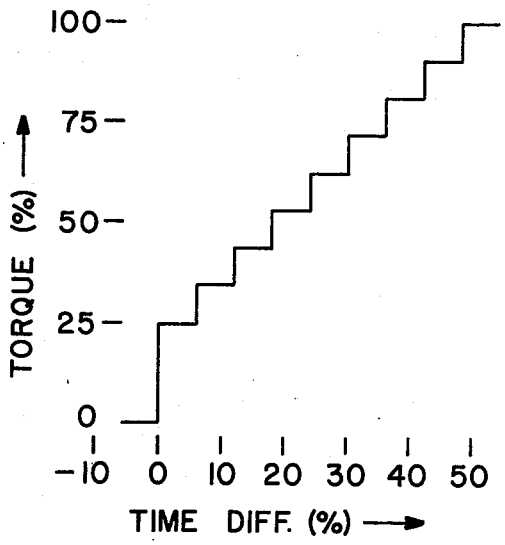

FIG. 22 shows for a third embodiment the fractional engine output torque for different degrees of slowing below a nominal engine speed.

Figures 23, 24, 25:
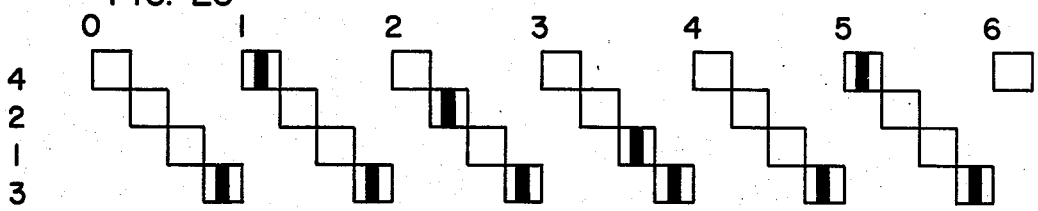

FIG. 23 tabulates enabled and inhibited fuel injection for the second embodiment.

FIG. 24 tabulates enabled and inhibited fuel injection for the third embodiment.

FIG. 25 shows timing of enabled and inhibited cycles for the second embodiment.

Figure 26:
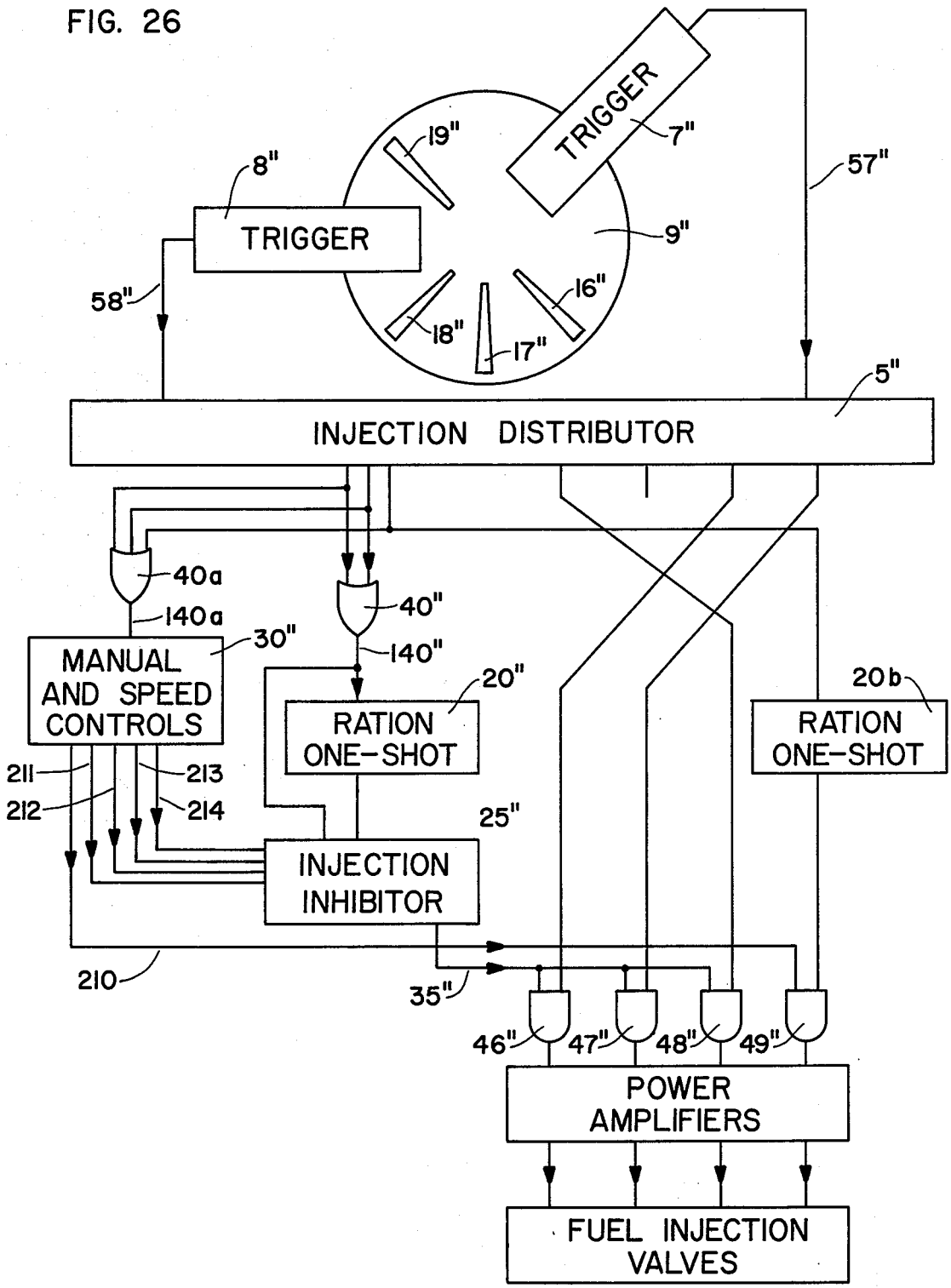

FIG. 26 is a block diagram of the third embodiment.

Figure 27:
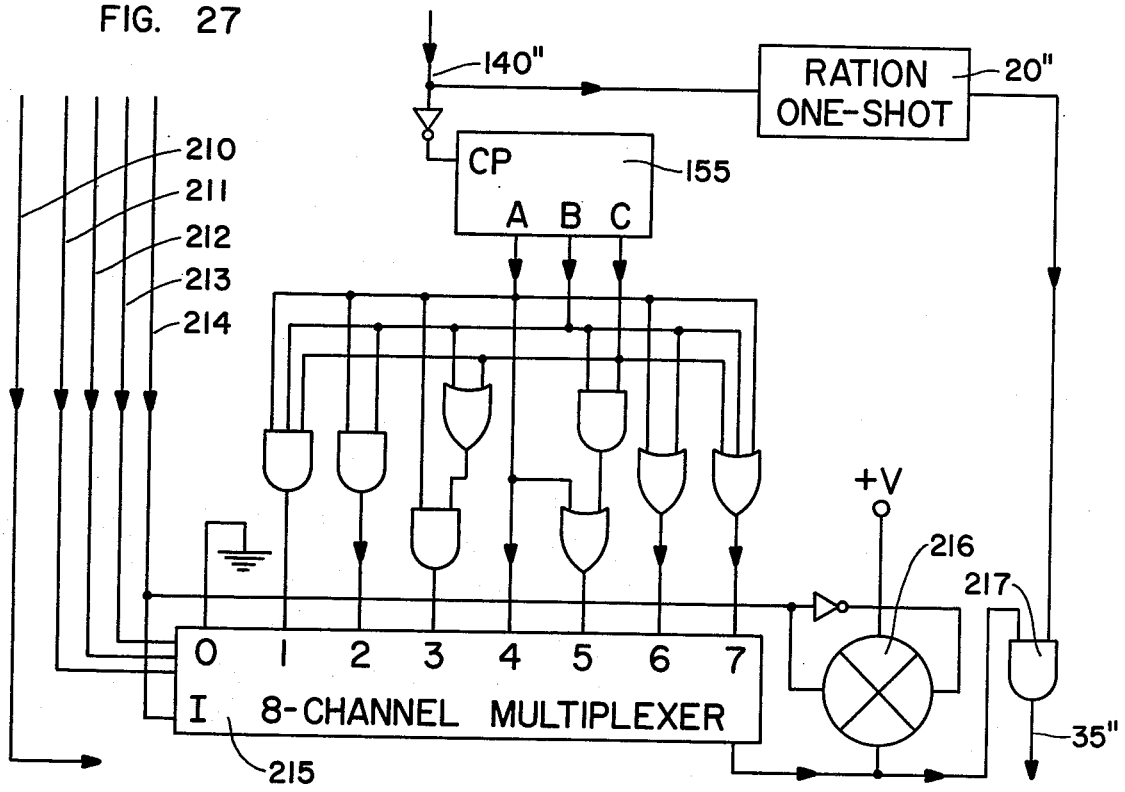

FIG. 27 diagrams the fuel injection inhibitor for the third embodiment.

Figure 28:
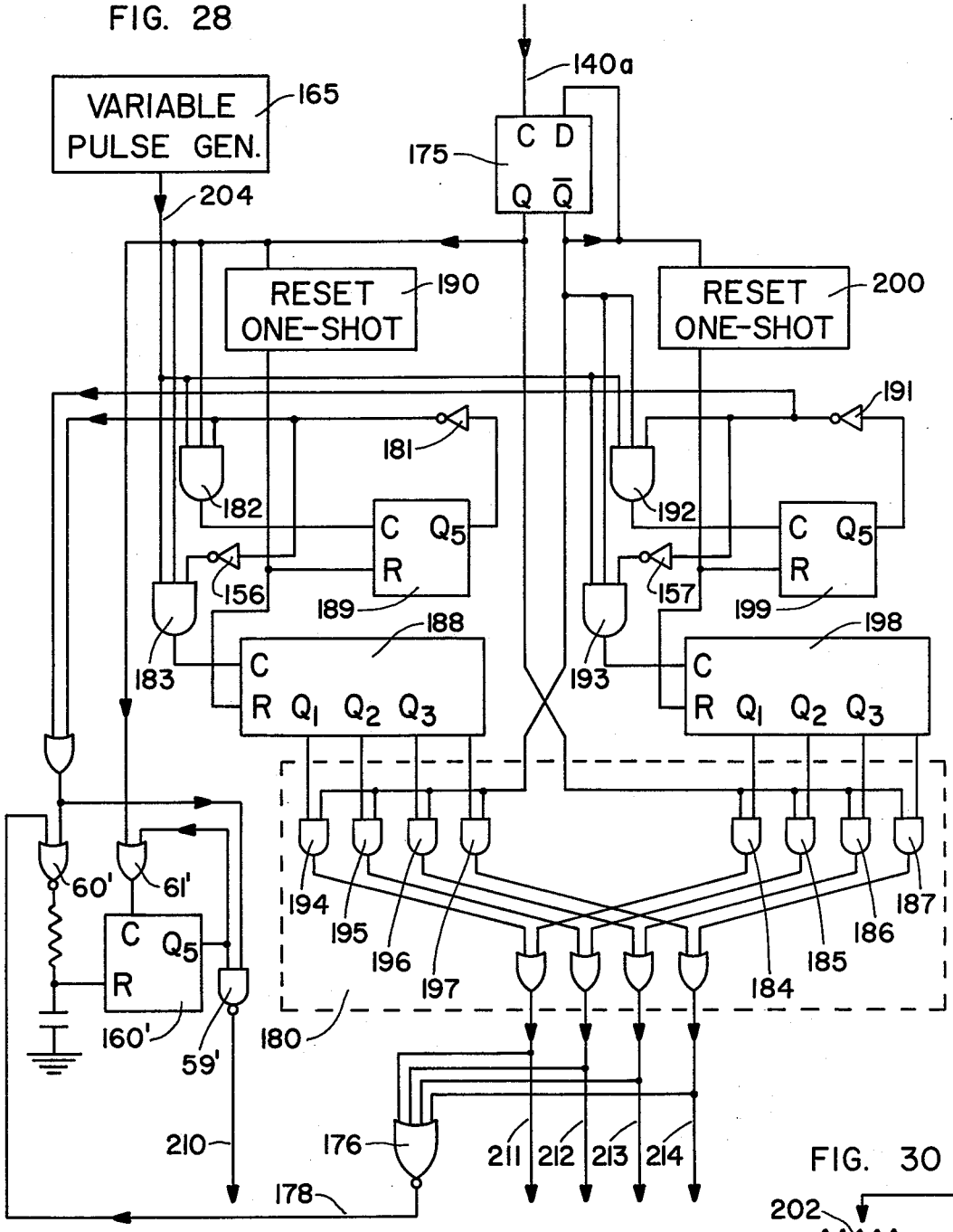

FIG. 28 diagrams the manual and speed control for the third embodiment.

Figure 29:
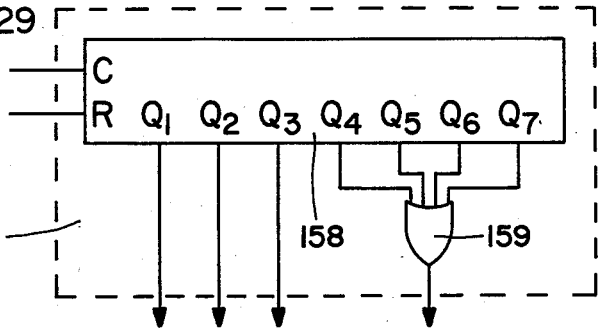
Figure 30:
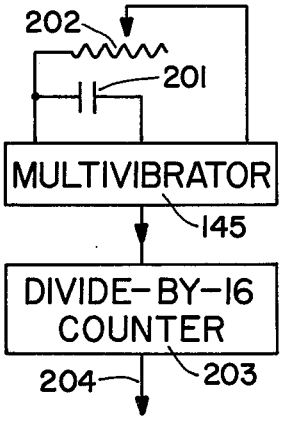

FIG. 29 shows a pulse counter for the manual and speed control. FIG. 30 shows a variable pulse generator for the manual and speed control.

DESCRIPTION OF THE PREFERRED EMBODIMENT

My engine has four combustion chambers, each defined by a cylinder with a fixed closure at one end and a movable piston at the other end. The four cylinders are in a line, and their four pistons are connected to a common crankshaft. Each cylinder has an electrically actuated fuel injector valve. This valve is positioned to spray gasoline into the cylinder past its air inlet valve, while it is open, during the air inlet stroke. The mixture of air and fuel in each cylinder is compressed by the piston and it is ignited by means of an electric spark near the end of the compression stroke. The fuel supply system is shown in FIG. 1.

Referring to FIG. 1, a liquid fuel such as gasoline is stored in the bottom part of the fuel tank. The top part of the fuel tank communicates with the atmosphere. Since the pressure of the gasoline vapor is less than atmospheric pressure, the top part of the fuel tank usually contains some air, which is mixed with the gasoline vapor. The liquid gasoline in the bottom part of the fuel tank is substantially free of air. Gasoline is drawn from the bottom of the fuel tank by an electrical fuel supply pump of fixed displacement. This gasoline is forced into a fuel line and through the four fuel injection valves into the engine. Fuel pumped from the fuel tank in excess of engine requirement is returned through a pressure regulator to the fuel tank. The absolute pressure in the fuel line is adjusted to be approximately three times the external atmospheric pressure.

Fuel in the fuel line has substantially the same composition as the liquid fuel in the bottom part of the fuel tank, the liquid fuel in both vessels being unmixed with air.

One of the combustion chambers is shown in FIG. 3. Movable piston 14 slides in cylinder 4. The piston is connected to one end of connecting rod 24. Air enters through inlet duct 34; exhaust gases are discharged through exhaust duct 44. Air inlet valve 54 is shown open while exhaust valve 64 is shown closed. Fuel injector valve 74 is mounted in inlet duct 34. This fuel injector valve receives liquid gasoline under pressure from branch fuel line 84, and sprays it past the open air inlet valve.

The electrically actuated fuel injector valve is normally closed. It is opened, and held open long enough to deliver a fuel ration, by precise electronic gating. The air fuel mixture is then compressed by the piston, and ignited by a spark at spark plug 94. A sectional side view of the engine is shown in FIG. 2.

Referring to FIG. 2, four cylinders 1–4 are fitted with pistons 11–14. These are connected to crankshaft 10 by means of connecting rods 21–24. Flywheel 15 is mounted on one end of the crankshaft and rotates with it. Power strokes in the different cylinders are timed in the order 1-3-4-2, with consecutive power strokes being spaced apart by 180° of crankshaft travel.

Crankshaft 10 is geared to a camshaft and to an electrical timing shaft (not shown), both of which rotate at one half crankshaft speed. The camshaft actuates the four air inlet valves and the four exhaust valves. The electrical timing shaft provides timing for spark ignition and for electronic fuel injection.

Electric power for ignition is provided by a unit commonly known as the Delta Mark Ten Capacitor Discharge Ignition Unit, marketed by Delta Products, Inc. Triggering of the capacitor discharge is accomplished by photoelectric sensing of a slotted disk rotating with the electrical timing shaft. The photoelectric trigger is a commercial unit, the OPTO XR-CD trigger marketed by the Allison Automotive Company. This photoelectric trigger, which replaces the traditional breaker points, accepts the breaker point lead of the Delta Capacitive Discharge Unit.

Figure 4:
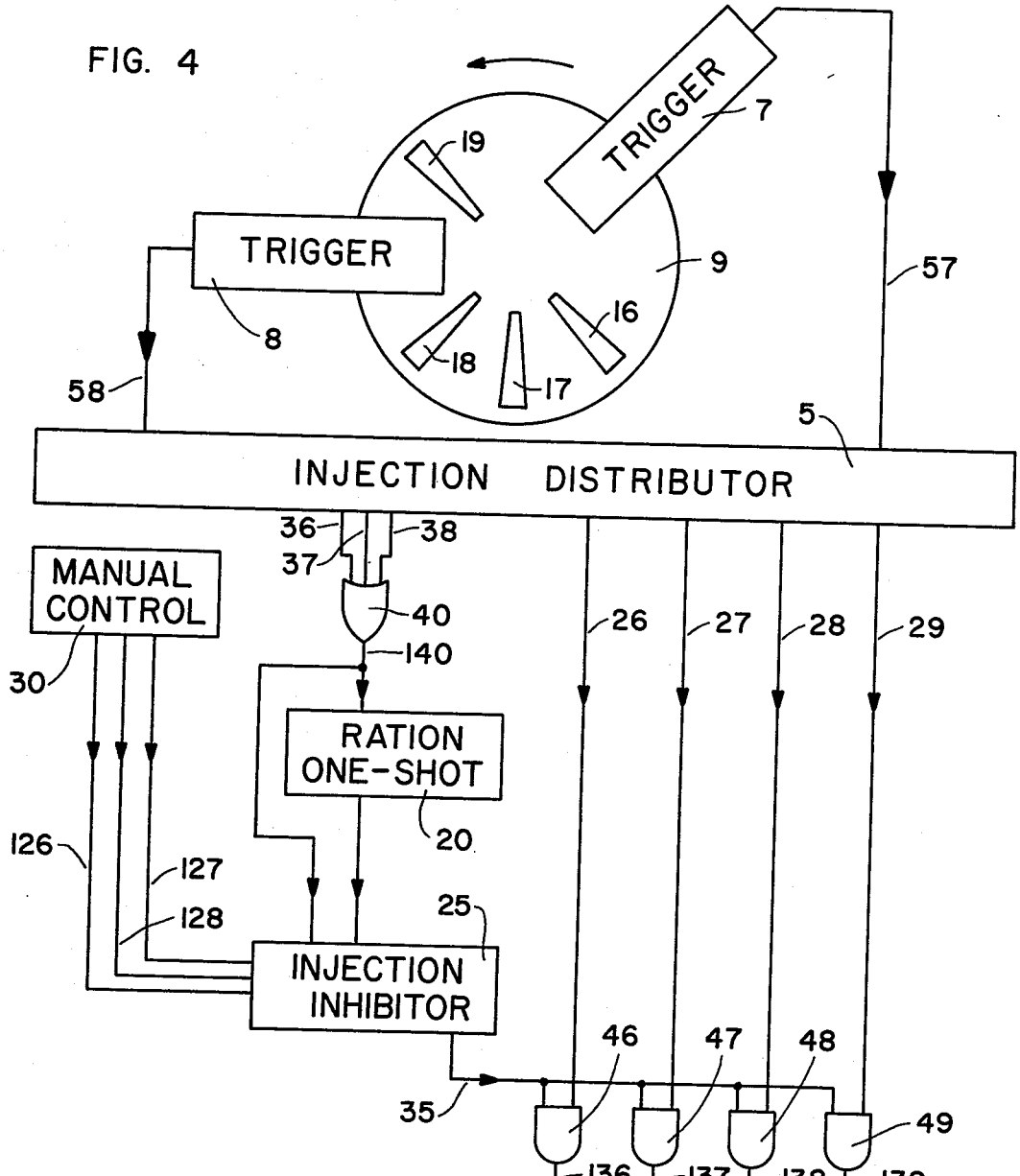
FIG. 4 is a block diagram of the preferred embodiment.
Figure 5:
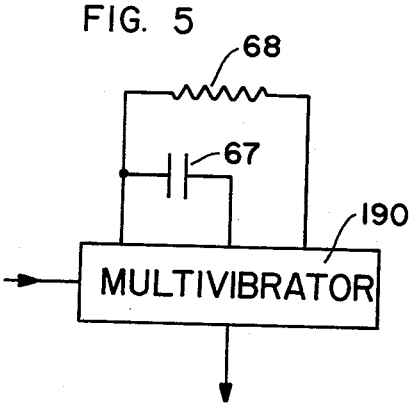
FIG. 5 shows timing elements for a one-shot used to reset speed control counters.

Timing and distribution of fuel injection is accomplished by two more OPTO XR-CD trigger units sensing a second slotted disk, mounted on the same timing shaft. Referring to FIG. 4, injection timing disk 9 carries four slots 16,17,18,19. There is a unique position of the disk for which the engine timing triggers operate simultaneously, namely the position in which slot 17 is passing trigger 8 while slot 19 passes trigger 7. Both triggers are electrically connected to an injection distributor 5, which serves to distribute fuel injections to the cylinders in the order that their air inlet valves open. The distributor also provides trigger pulses for a gasoline rationing one-shot 20 and a fuel injection inhibitor 25.

Distributor 5 transmits four injection enabling signals on leads 26–29, each enabling signal having a duration of 90° of timing shaft rotation, or 180° of crankshaft rotation. At the beginning of each enabling signal, a short, positive trigger signal is also generated, the four trigger pulses being transmitted on three leads 36,37,38. In the preferred embodiment, all four trigger pulses are received by the three-input OR gate 40. Thus the output of the OR gate, on lead 140, is a series of four positive trigger pulses spaced apart by 180° of crankshaft travel. This output goes to the rationing one-shot 20 and to the injection inhibitor 25. The injection inhibitor also receives steady inputs on leads 126,127,128 from manual control 30.

The injection inhibitor has a single output lead 35 which feeds one input of each of four AND gates 46–49. The other inputs of these 2-input AND gates are supplied via leads 26–29 from the injection distributor, which enable the AND gates in the cyclical order 46-47-48-49. Outputs from the four AND gates go to four power amplifiers, which drive the four fuel injection valves. Details of different blocks of FIG. 4 are shown in FIGS. 5–10. A diagram of the injection distributor is shown in FIG. 6.

Referring to FIG. 6, output leads 57,58 from the engine timing triggers are normally grounded, but during the instant when a slot is passing a trigger, the output of that trigger is open-circuited. This allows the trigger output lead to be pulled up to the upper power supply potential +V (which may be 8 to 12 volts) by means of pullup resistor 52 to 53 (one kilohm). Lead 57 goes to the clock input of a divide-by-four counter comprising two flip-flops 76,77. The true and complementary outputs of flip-flop 76 are designated A, $\overline{A}$. Those of flip-flop 77 are B, $\overline{B}$. The complementary output of each flip-flop is connected to its own data input, so that each flip-flop toggles. The complementary output of flip-flop 76 is connected to the clock input of flip-flop 77.

The signal from the other engine timing trigger, received on lead 58, goes to the clock input of a similar divide-by-four counter comprising flip-flops 86, 87. The true and complementary outputs of flip-flop 86 are F, $\overline{F}$. Those of flip-flop 87 are G, $\overline{G}$. The signals from the two triggers also go to the two inputs of AND gate 66, whose high level output is used to reset all flip-flops 76,77,86,87 to zero. Timing of the trigger signals and the counter outputs A,B,F,G is indicated in FIG. 8.

Figure 8:
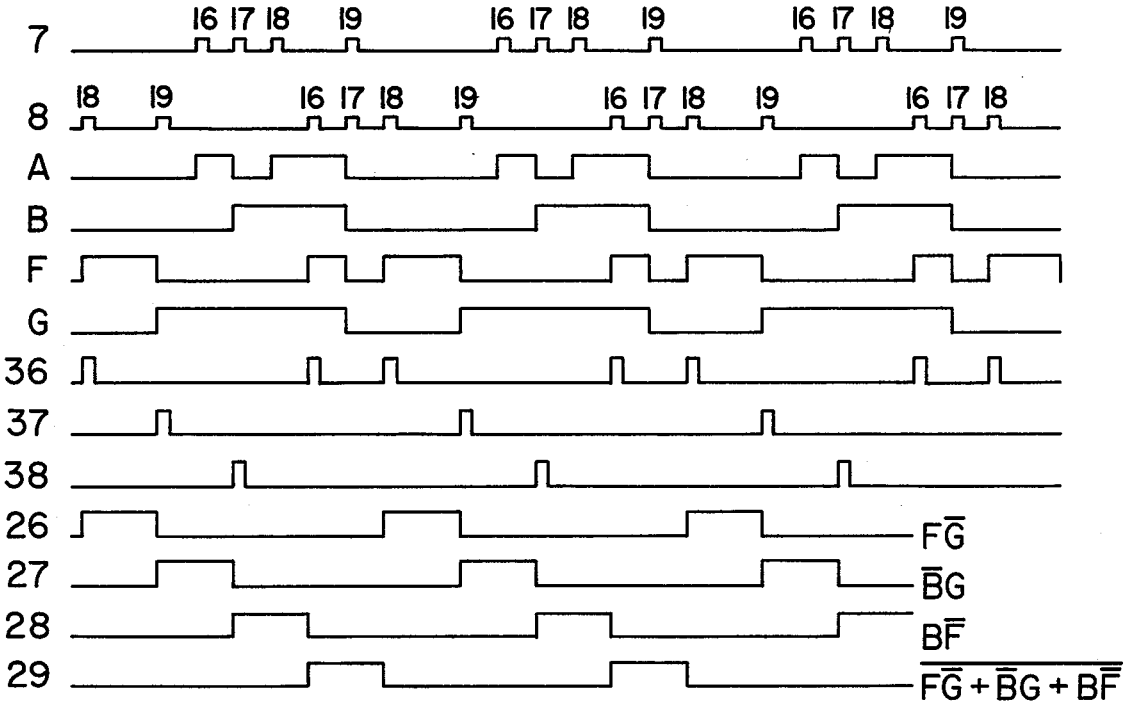
FIG. 8 is a timing diagram for electrical pulse generation.

Referring to FIG. 8, the first two sequences of pulses shown are those received from the two engine timing triggers 7 and 8. At the left of each row of pulses is a number identifying the trigger from which the pulses are received. Above each pulse is a number identifying the particular slot 16,17,18, or 19 (shown in FIG. 4) which produces that particular pulse. The next four lines of FIG. 8 show flip-flop outputs A,B,F,G, the flip-flop output literal for each row of pulses being shown at the left of each row of pulses. The time coincidence of slot 19 on trigger 7 and of slot 17 on trigger 8 resets both counters to zero.

Referring to FIG. 6, the flip-flop outputs B,F,G are connected to one-shots 78,88,89 respectively, so that the positive-going transitions of B,F,G trigger short output pulses from these three one-shots. Timing elements determining the duration of the output pulse of one-shot 78 are shown in FIG. 7, where a capacitor 69 is 4000 pf and resistor 70 is adjustable, with a maximum resistance of 500 kilohms. One-shots 88,89 have identical timing elements. Trigger pulses from one-shots 78,88,89 are transmitted on output leads 38,36,37 respectively, as shown in FIG. 8.

Referring to FIG. 4, OR gate 40 combines these pulses in a single output lead 140. This is connected to the injection inhibitor 25 and to a single rationing one-shot 20 which measures out a fuel ration for each of the four cylinders. Some means of distributing these rations to the proper cylinders is needed. For this purpose, injection enabling signals are generated in the distributor using the same four flip-flops.

Timing of these four enabling signals is shown in the last four lines of FIG. 8. At the beginning of each pulse train is shown a number referencing the distributor output lead. At the end of each train of pulses is shown a Boolean algebraic expression specifying, for that enabling signal, the gated connection between the distributor output lead and the true and complementary outputs from the distributor counters.

Referring to FIG. 6, AND gate 96 receives inputs from F and $\overline{G}$. The gate output signal, transmitted on output lead 26, enables injection for a first cylinder.

AND gate 97 of FIG. 6 receives inputs from G and $\overline{B}$. The gate output signal, transmitted on output lead 27, enables injection for the next-firing cylinder.

AND gate 98 receives inputs from B and $\overline{F}$. The gate output signal, transmitted on output lead 28, enables injection for the next-firing cylinder.

NOR gate 99 enables injection for the last-firing cylinder by receiving inputs from leads 27,28,29 and transmitting its inverted output on lead 29. Thus, as shown in FIG. 8, the injection distribution to the four cylinders is determined by four positive enabling pulses, each pulse lasting 90° of timing shaft travel, or 180° of crankshaft travel.

Referring again to FIG. 4, in order that the rationing one-shot 20 will produce an output pulse well within the cylinder enabling pulses transmitted on leads 26–29, triggering of the rationing one-shot is delayed after the start of the cylinder enabling pulses. This is achieved by triggering the rationing one-shot on the negative-going trailing edge of the short positive pulses received on lead 140, the amount of delay being adjusted by varying the widths of the output pulses on leads 36,37,38. Normally, the widths of these output pulses are made equal to each other. The manual control 30, injection inhibitor 25, and rationing one-shot 20 are shown in FIG. 9A.

Figure 9A:
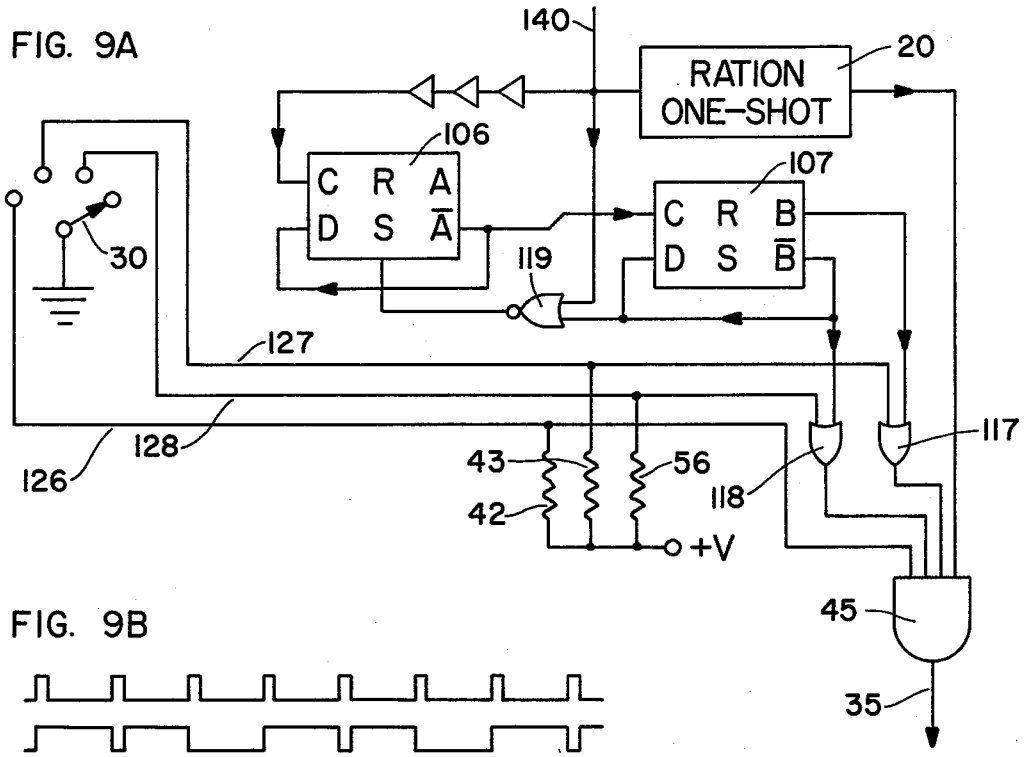

Referring to FIG. 9A, the trailing edges of electrical pulses received on lead 140 trigger the rationing one-shot 20. The output signal from this one-shot is a positive pulse whose duration determines the time that a fuel injection valve will remain open, which time determines the size of the fuel ration for each cylinder cycle. Within a particular cylinder cycle, a cylinder never receives a partial ration: it always receives a full ration adequate for reliable firing and burning, or else it receives no fuel ration at all in that cylinder cycle.

The size of the fuel ration is adjustable, depending on the current air inlet pressure. For this purpose, rationing one-shot 20 has an adjustable timing element which determines the duration of its output pulse, as shown in FIG. 7. Variable resistance 70 has a maximum resistance of 500 kilohms. For a given air intake pressure, the resistance is adjusted for good fuel economy and low atmospheric pollution. Capacitor 69 is 4000 pf.

Referring again to FIG. 9A, when rationing one-shot 20 receives a trigger pulse on lead 140, it always provides a potential fuel rationing output pulse, but this signal can be overridden, or disabled, or inhibited by the inhibitor at AND gate 45. Whether the rationing pulse is enabled or inhibited depends on the setting of manual control 30 and on the condition of flip-flop 107.

Manual control 30 is a single pole rotary switch with its rotor contact grounded. The switch has four positions corresponding to different fractions (of the total number of engine cycles) which have their fuel injection enabled. From left to right, the four enabled fractions are zero, one third, two thirds, and unity.

When switch 30 is in its last position (shown), leads 126,127,128 are held at the upper power supply voltage +V by means of pullup resistors 42,43,56 respectively. Thus AND gate 45 is enabled continuously, transmitting each high level pulse from the rationing one-shot on lead 35. The engine then develops its full output torque (for its given air inlet pressure).

When switch 30 is in its first position, lead 126 is grounded, so that AND gate 45 is continuously inhibited, and the high level rationing pulse never reaches the output lead 35. The engine then develops zero torque.

When switch 30 is in its second or third position, the rationing pulse may be enabled or inhibited, depending on the count of the inhibitor counter.

The inhibitor has a divide-by-three number counter comprising D-type flip-flops 106,107. The true and complementary outputs of flip-flop 106 are labeled A, $\overline{A}$. Those of flip-flop 107 are labeled B, $\overline{B}$. Output $\overline{A}$ is connected to the clock input of flip-flop 107. Outputs B, $\overline{B}$, are connected to inputs of OR gates 117, 118, whose outputs are connected in turn to inputs of AND gate 45.

In order to make each flip-flop toggle, its complementary output is connected back to its own data input. In order to limit the total count to three, complementary output $\overline{B}$ is fed back to the set input of flip-flop 106, via NOR gate 119, which is enabled by a low input on clock input lead 140.

Figure 9B:
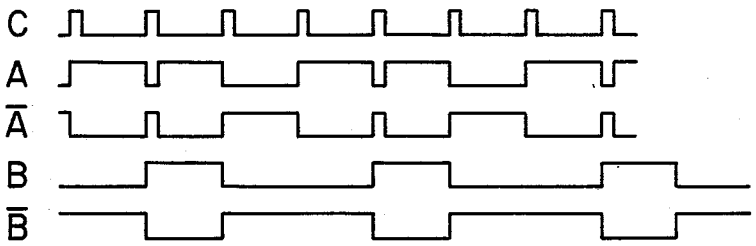

The clock pulses coming in on lead 140 are shown in FIG. 9B (the first line, labeled C). These pulses are spaced at 180° of crankshaft travel. The next two lines of FIG. 9B show the true and complementary outputs of flip-flop 106, labeled A and $\overline{A}$. The last two lines of FIG. 9B show the true and complementary outputs of flip-flop 107, the true output being high for one third of all cylinder cycles, the complementary output being high for two thirds of all cylinder cycles.

Referring again to FIG. 9A, the manual control 30, when in its second position, grounds lead 127. This enables OR gate 117 to inhibit AND gate 45 during two thirds of the cylinder cycles. The engine averages one third of full torque.

When manual control 30 is in its third position, it grounds lead 128. This enables OR gate 118 to inhibit AND gate 45 during one third of the cylinder cycles. The engine averages two thirds of full torque.

In speaking of average engine output torque, the torque is taken to be the average work done by the explosion of air-fuel mixtures per radian of flywheel rotation, neglecting engine friction and pumping losses. Thus the fraction of full engine output torque is the fraction of total cylinder cycles with enabled fuel injection.

Referring again to FIG. 4, lead 35 from the injection inhibitor 25 provides one input to each of four AND gates 46–49. One of these gates at a time is enabled by a positive signal on one of the leads 26–29 from distributor 5. The four AND gates are enabled in the cyclical order 46-47-48-49. Gate outputs on leads 136–139 go to four power amplifiers, which drive the four fuel injector valves. Power amplifiers and injector valves are shown in FIG. 10.

Referring to FIG. 10. Darlington transistors 146–149 have their input bases connected to leads 136–139 respectively. The transistor emitter leads are connected through resistors 151–154 to solenoids of the four fuel injector valves 71–74 respectively. The fuel valves transmit liquid gasoline from branch fuel lines 81–84 into cylinders 1–4 respectively. When the engine is operating at full output torque, fuel is injected into the four cylinders in the cylinder order 1-3-4-2.

Each rationing pulse enabled by the injection inhibitor turns on one of the power transistors, depending on which one of AND gates 46–49 of FIG. 4 has been enabled by the distributor. At the end of each pulse, the power transistor cuts off, but the current through the solenoid of the injection valve tends to continue flowing. In order to prevent damage to the transistor, the circulating currents are provided with a return path by way of diodes 171–174, shown in FIG. 10.

In FIGS. 4 to 10, reference numbers represent commercial components as follows:

46,47,48,49,66,96,97,98 represent AND gate CD4081B
117,118 represent OR gate CD4071B
40 represents OR gate CD4075B
99,119 represent NOR gate CD4025A
20,78,88,89 represent multivibrator CD4098A
76,77,86,87,106,107 represent D-flip-flop CD4013A
146,147,148,149 represent Darlington transistors MPSU45

The integrated circuits are marketed by RCA; the Darlington transistors are marketed by Motorola.

The four cylinder engine of the preferred embodiment always has the engine load distributed uniformly over the four cylinders. For operation at one third of full output torque, the injection distribution in time is shown in FIG. 11.

In FIG. 11, time is measured horizontally in units of a combustion chamber cycle time, also called a cylinder cycle time. Each cylinder cycle time has the duration of two crankshaft revolutions. Injections for cylinders 1,3,4,2 are shown in FIG. 11 on successive vertical levels. Air induction strokes with inhibited fuel rations are indicated by blank squares: air induction strokes with enabled fuel rations are indicated by squares containing a black segment. For the engine as a whole, enabled injections are spaced at equal intervals of 540° of crankshaft travel, or three quarters of a cylinder cycle time. The pattern of enabled injections repeats itself every three cylinder cycle times.

During the time interval occupied by three cycles of cylinder no. 1, there are a total of 12 induction strokes, of which one third, or four induction strokes, have enabled injections. These four enabled injections are distributed equally among the four cylinders. For other time intervals, the fraction of enabled injections may vary slightly from one third. Thus during the time interval occupied by the first five cycles of cylinder no. 1, out of a total of 20 induction strokes, seven have enabled injections. This fraction is 35 percent.

For the above time interval, the seven enabled injections are distributed among the four cylinders as follows:

| Cylinder Number | No. of Enabled Injections |
|---|---|
| 1 | 2 |
| 3 | 1 |
| 4 | 2 |
| 2 | 2 |

Considering only the five cycles of cylinder no. 1, a fuel ration is enabled in two cycles and inhibited in three cycles. Thus the first fraction of first cylinder cycles with enabled fuel rations is forty percent, and the remaining fraction of first cylinder cycles with inhibited fuel rations is 60 percent. For each of the other individual cylinders, the number of their cylinder cycles that contain a fuel ration is nearly equal to the number for cylinder no. 1, the difference being not more than one cycle.

FIG. 12 shows the injection distribution in time for engine operation at two thirds of full torque. Engine air induction strokes with enabled fuel rations are spaced alternately at 180° and 360° of crankshaft travel. During the time interval occupied by the first five cycles of cylinder no. 1, there are a total of twenty cylinder cycles, of which fourteen have enabled injections. This fraction is seventy percent. The fourteen enabled injections are distributed among the four cylinders as follows:

| Cylinder Number | No. of Enabled Injections |
|---|---|
| 1 | 4 |
| 3 | 3 |
| 4 | 3 |
| 2 | 4 |

The number of first cylinder cycles with enabled fuel injections is 4 out of 5, or 80 percent. Again, for each of the other individual cylinders, the number of their cycles with enabled fuel injections is equal to the number of first cylinder cycles with enabled fuel injection, within two cycles.

When my engine must be operated with a torque output well below its maximum possible value, the manual control of the injection inhibitor is set for either one third or two thirds of full torque. Thus heavy air throttling is not needed and the throttle can be kept near the point of peak engine efficiency.

The engine has a water jacket with forced circulation of water to a radiator for cooling, and a conventional thermostat for inhibiting the flow of cooling water until the water jacket is hot enough for efficient engine operation. When water flowing through the radiator becomes too hot, its high temperature is sensed and a cooling fan is automatically turned on to force ambient air through the radiator.

Cylinder cycles with inhibited fuel injection tend to either oxidize or cool any hot carbon deposits within the cylinder, thus discouraging preignition. This action is particularly effective at low torque levels that tend to develop carbon deposits in conventional engines.

Because of the adequate air pressure and the quick acting electronic control, my engine can respond very strongly and rapidly to a change of the torque control.

OTHER EMBODIMENTS

My invention can be used to coordinate fuel inhibition in different cylinders of any multicylinder engine with electrically controlled fuel injection. An essential ingredient of the invention is information storage, but it need not use an exactly periodic injection pattern, and the particular divide-by-three counter shown in FIG. 9 would be unsuitable for some engines. Thus if the injection inhibitor of FIG. 9 were used in a six cylinder engine to reduce output torque to one third of full torque, only two of the six cylinders (nos. 1 and 4) would be receiving fuel ration. The enabled injections would be distributed as shown in FIG. 13.

If the inhibitor counter were made to count to four, instead of three, then for operation at one quarter of full torque the distribution of fuel injections in time would be as shown in FIG. 14. Here only three of the six cylinders are receiving fuel rations (nos. 1,3,5).

On the other hand, when a divide-by-five counter is used in the same way in the injection inhibitor, then fuel rations are distributed evenly to all cylinders, as shown in FIG. 15 for the special case where the engine is operated at one fifth of full torque. Generally, if a divide-by-N counter is to be used in this way to distribute enabled and inhibited injections uniformly over M cylinders, then the integer N should be prime with respect to M. That is, M and N should not have a common divisor greater than one.

Considering as an example a three cylinder engine, an inhibitor counter with a divide-by-four counter will distribute inhibitions evenly over the three cylinders, since the numbers three and four are relatively prime. FIG. 16 shows this arrangement for the special case where the engine is operated at one fourth of full torque.

In my four cylinder engine, small amounts of the compressed air-fuel mixture leak past the pistons into a common enclosure, usually termed a crankcase. If these gases are not oxidized by some means, they contribute to atmospheric pollution. Therefore, in the second embodiment of my invention, one of the four cylinders is selected to be injected with fuel during each of its cycles, in order that it may completely reburn all of the leaking gases.

FIG. 17 shows the engine of the second embodiment with its wall partly cut away to show the four connecting rods 21'–24' in the common crankcase 50. Air passes through air cleaner 109 and air inlet ducts 31',32',34' into cylinders no. 1, 2, 4. Other air passes through separate air cleaner 39 and air inlet duct 33' into cylinder no. 3. To reburn the leaking (blowby) gases, they are sucked out of the common crankcase 50 through ducts 51 and 33' into cylinder no. 3. This arrangement provides an inexpensive means of oxidizing all of the blowby gases, thereby materially reducing atmospheric pollution.

A block diagram of the fuel injection control for the second embodiment is shown in FIG. 19. Here the triggers 7',8', timing disk 9', and injection distributor 5' are the same as those for the preferred embodiment. Output lead 38' from the distributor is connected to rationing one-shot **20*a*. The other two distributor leads 36', 37' provide inputs to OR gate 40', whose output on lead 140 is connected to injection inhibitor 25' and to rationing one-shot 20'. This one-shot 20' measures out the fuel ration for cylinders no. 1,2,4. The separate one-shot 20*a* allows separate adjustment of the fuel ration for cylinder no. 3. Each of these one-shots is provided with timing elements, as indicated in FIG. 7** for the preferred embodiment.

The AND gates 46'–49', the power amplifiers, and the fuel injection valves are the same as those for the preferred embodiment. Manual control 30' is diagramed further in FIG. 18.

Referring to FIG. 18, six pushbuttons 100–105 are arranged so that a selected one of them can momentarily ground one of the leads 110–115 respectively. Each of these leads is connected to an input of five of the six NAND gates 120–125. This lead is also connected to the output of the sixth NAND gate via a 10 kilohm resistor.

The interconnections between the six NAND gates are such that one of them will have a stable low output and the other five will have a stable high output. Momentary depression of pushbutton 100, for example, will disable the five NAND gates 121–125, which will then supply high inputs to NAND gate 120, thus giving it a stable low output. This situation will prevail until another pushbutton is momentarily depressed. Bouncing of a pushbutton contact will have no effect at the output leads.

The outputs of NAND gates 120–125 are inverted by inverters 116 before they are transmitted, on leads 130–135, to the fuel injection inhibitor. The injection inhibitor 25' and the rationing one-shot 20' are diagramed in FIG. 20.

Referring to FIG. 20, electrical pulses entering on lead 140' serve as clock pulses to divide-by-four counter 150 in the injection inhibitor. The incoming pulses also serve as trigger pulses for the rationing one-shot 20'. The output pulse from the rationing one-shot must be transmitted through AND gate 90, which is enabled or inhibited according to a series of signals generated by the inhibitor counter. The desired series of signals is selected by opening one of a set of five electronic switches 166–170.

Divide-by-four counter 150 has first and second stage outputs A and B feeding AND gate 71 and OR gate 72. Three output signals are thereby generated to produce engine output torgues equal to 44,62, or 81 percent of full output torque. The gate connections to electronic switches 166–170 are indicated in FIG. 23, where the seventh column gives the Boolean algebraic expression describing the gated outputs from the inhibitor counter.

FIG. 23 tabulates the enabled and inhibited fuel injections for five control switch states and for all four counts of the inhibitor counter. In this figure,

1 represents a high potential which enables fuel injection,

0 represents a low potential which inhibits fuel injection. There is no permanent correlation of this data with particular cylinders, since the cylinder associated with each inhibitor count keeps changing. The last column of FIG. 23 gives the average fraction of enabled fuel injections for each manual switch state, including the uninhibited injection from cylinder no. 3.

Referring to FIG. 20, The three output signals from the injection counter are transmitted via electronic switches 167–169 to AND gate 90. Only one of the electronic switches 166–170 can be opened at a time, by a high signal on one of the leads 131–135.

A high signal on lead 135 opens switch 170, thereby presenting a continuous high potential of +V on lead 91 to AND gate 90, which enables injection in all cylinder cycles and produces full engine output torque.

A high signal on lead 131 opens switch 166, thereby presenting a continuus ground potential on lead 91 to AND gate 90, thus inhibiting injection in all cycles of cylinders 1,2,4, and producing one quarter of full engine output torque.

A high signal on either lead 131 or lead 130 to NOR gate 60 indicates that generation of polluting blowby gases in cylinders 1,2,4 has ceased, and allows delay counter 160 to count.

After a sufficient time has elapsed to reburn the blowby gases in the crankcase, output $Q_6$ of counter 160 goes high, enabling NAND gate 59. Thereafter, a high signal on lead 130 to NAND gate 59 will produce a low signal on output lead 141. This inhibits all fuel injections for cylinder no. 3, thereby reducing the engine output torque to zero. In order to complete burning of any blowby gases from the other three cylinders, cutoff of cylinder no. 3 is delayed by about forty engine strokes by means of delay counter 160. A count of 32 on delay counter 160 produces high inputs to OR gate 61 and NAND gate 59, which stop the count and enable a low output on lead 141. The mechanism for this inhibition of fuel injection into cylinder no. 3 is indicated in FIG. 19. Referring to FIG. 19, a low potential on lead 141 disables AND gate 49', thereby blocking transmission of the fuel rationing pulse from rationing one-shot **20*a*** to its fuel valve.

Referring again to FIG. 20, a high signal on one of leads 132,133,134 opens one of switches 167,168,169 respectively, thereby connecting the gated counter output via lead 91 to AND gate 90. Thus depressing one of pushbuttons 102, 103, or 104 of FIG. 18 results in fuel inhibition in a fraction of the cylinder cycles, as tabulated in FIG. 23.

For example, depression of pushbutton 102 will produce an enabled fraction of 44 percent of the total number of cylinder cycles, the enabled cycles being distributed in time among the four cylinders as shown in FIG. 25. In FIG. 25, as in FIGS. 11 to 16, time is measured horizontally in units of a cylinder cycle time. It is seen in FIG. 25 that cylinder no. 3 is enabled continuously; each of cylinders 1,2,4 is enabled during a quarter of its cycles. Thus the total enabled fraction is seven sixteenths or about 44 percent. The injection pattern is periodic with a period of four cylinder cycles.

As in the preferred embodiment, manual control of injection inhibition allows the air intake throttle to be kept near the point of peak engine efficiency.

The fraction of cylinder cycles with enabled injections is also shown graphically in FIG. 21 for the six different states of the manual control switch. Most of the fractional jumps for this embodiment are 19 percent, as compared with fractional jumps of 33 percent for the preferred embodiment. The second embodiment produces little atmospheric pollution.

Instead of having its average output torque set manually, my inhibited engine can be made to respond to a variable load by adjusting its output torque automatically, in dependence on one or more engine operating parameters. A block diagram for such a mode of operation is shown in FIG. 26. It is to be understood that the term "manual" includes "pedal".

Referring to FIGS. 26,28, the timing disk 9'', triggers 7'',8'' and distributor 5'' are like those in the preferred embodiment. Rationing one-shots **20'',20*b*, delay counter 160' and NAND gate 59' are like those in the second embodiment. OR gate 40*a* and its inputs from the distributor are like those in the preferred embodiment. The output of this gate consists of four trigger pulses during each cylinder cycle, the pulses being spaced from each other by 180° of crankshaft travel. This output is transmitted on lead 140*a*** to the combined manual and speed control.

Cylinder no. 3 is not inhibited except after the other three cylinders have been inhibited, so that cylinder no. 3 can burn the blowby gases from all four cylinders, as shown in FIG. 17 for the second embodiment.

Referring to FIG. 26, the manual control sets the nominal engine speed by establishing a nominal time for a single piston stroke. The speed control measures the fractional departure of the actual stoke time from its nominal value, stores this difference value, and transmits the difference information to the injection inhibitor. If the actual stroke time is equal to the nominal time, fuel injection to cylinders 1,2,4 is completely inhibited.

Referring to FIG. 22, the engine output torque is increased in proportion to the excess of the actual stroke time over the nominal stroke time. Full output torque is reached when the actual stroke time exceeds the nominal time by about 50 percent. If the nominal stroke time is set at its maximum of 50 milliseconds, corresponding to a nominal engine speed of 600 RPM, then full torque will be reached when the actual stroke time is 75 milliseconds, corresponding to an actual engine speed of 400 RPM. Similarly, if the nominal engine speed is increased to 2400 RPM, then full engine torque will be produced until the actual engine speed is up to 1600 RPM. Thus the accelerate from a low engine speed, the pedal is depressed to reduce the nominal stroke time. This will increase the engine output torque.

The nominal and actual stroke times are measured by means of a set of two cycle counters. Both of these count cycles of the same variable frequency pulse generator, whose frequency is varied manually by a pedal. As a convenient way of storing the difference information, two sets of counters are provided. One of these is used to measure the fractional time difference, while the other counter is being used to transmit to the inhibitor the difference information from the preceding measurement. Switching between the two sets of counters is accomplished by means of an electronic toggle. The manual and speed controls are diagrammed in FIG. 28.

Referring to FIG. 28, the nominal engine speed is chosen by setting the frequency of the variable frequency pulse generator 165, the nominal engine speed being proportional to the frequency of this pulse generator. Pulses coming from the distributor on lead 140*a* go to the clock input of toggle 175. Since these input pulses are separated by one piston stroke or half a crankshaft revolution, the toggle switches back and forth once for each crankshaft revolution.

As the true output from toggle 175 goes high, it triggers one-shot 190, whose output pulses resets binary counters 188 and 189. The timing elements for the reset one-shot 190 are like those shown in FIG. 5, with capacitor 67 equal to 100 pf and resistor 68 equal to ten kilohms.

The true output from toggle 175 goes also to an input of each of AND gates 182–187. The complementary output from the toggle goes to an input of each of AND gates 192–197. When the true output from the toggle goes high, its signal enables AND gate 182, starting counter 189 to count pulses from variable frequency pulse generator 165.

When counter 189 has counted up to 16, its $Q_5$ output goes high. This signal, passing through inverter 181, inhibits AND gate 182, then, passing through inverter 156, it enables AND gate 183. These actions stop counter 189 and allow counter 188 to start counting pulses from variable frequency pulse generator 165.

After the engine has rotated 180°, another input pulse on lead 140*a* switches toggle 175. The immediate result is to inhibit AND gates 182, 183, stopping counter 188. Now the toggle switching has enabled AND gates 194–197, so that the stationary count from counter 188 is transmitted in binary code on output leads 211–214 to the fuel injection inhibitor.

The four AND gates 194–197, together with alternate AND gates 184–187 are included in a single AND-OR integrated circuit package 180.

While counter 188 is transmitting its count to the inhibitor, the positive-going complementary output from the toggle has triggered reset one-shot 200, thus resetting binary counters 198 and 199. The complementary output from the toggle has also enabled AND gates 192 and 193, thus allowing counter 199 to count pulses from variable pulse generator 165. After counter 199 has counted up to 16, its $Q_5$ output sends a signal to inhibit gate AND 192 and enable AND gate 193. This stops counter 199 and allows counter 198 to start counting pulses from variable pulse generator 165.

When the engine has rotated another 180 degrees, a second input pulse on lead 140*a* switches toggle 175 back to its starting state. The immediate result is to stop counter 198. Since the toggle switching has enabled gates AND 184–187, the stationary count from counter 198 can now be transmitted in binary code on output leads 211–214 to the injection inhibitor.

The toggle is now back to its original state, so that the whole process will be repeated again and again for every revolution of the crankshaft.

Counter 188 is diagrammed in FIG. 29. Referring to FIG. 29, the seven stage binary counter 158 has four of its output leads from $Q_4$,$Q_5$,$Q_6$, and $Q_7$ connected to a 4-input OR gate 159, whose output is connected to AND gate 197 of FIG. 28. Counter 198 of FIG. 28 is identical to counter 188, and the output from its OR gate is connected to AND gate 187 of FIG. 28.

The variable frequency pulse generator is diagramed in FIG. 30. Referring to FIG. 30, monostable multivibrator 145 has its frequency determined by capacitor 201 and variable resistor 202. The capacity is 440 pf. The resistance, varied by the pedal control, is between 10 kilohms and 100 kilohms. This resistance range gives a pulse interval varying between 19.4 microseconds and 194 microseconds. The output frequency is divided by 16 by means of counter 203. Thus the output of the divide-by-16 counter on lead 204 has a pulse interval varying between 310 microseconds and 3.1 milliseconds.

Referring again to FIG. 28, the time required for counter 189 to count to 16 varies between 5 milliseconds and 50 milliseconds. Since this is the time occupied by half a crankshaft revolution, the nominal engine speed varies between 6000 RPM and 600 RPM. As the actual engine speed drops below the nominal speed, the output count of counters 188 and 198 increases from zero to 8, there being a total of nine different values for the output count. This output count, transmitted in binary code on leads 211–214, can produce nine different states of the fuel injection inhibitor. Thus the relative output torque of the engine varies from 0.25 to 1.0 in eight steps.

To decelerate, the pedal control is raised to increase the nominal stroke time. This may reduce the count on counters 188 and 198 to zero, and it may even prevent counters 189 and 199 from reaching their "nominal" count of 16. Any such increase of the nominal stroke time over the actual stroke time is made to cut off cylinder no. 3, after a short delay regulated by counter 160, which allows cylinder no. 3 to burn up any residual blowby gases from the other three cylinders.

The first eight torque states are controlled by binary code on leads 211, 212, 213. The two additional states are controlled by leads 214 and 210. Details of the injection inhibitor are shown in FIG. 27.

Referring to FIG. 27, injection triggering signals for cylinders 1,2,4 enter the inhibitor on lead 140″ and trigger fuel rationing one-shot 20″. The fuel rationing output from this one-shot can be enabled or inhibited at AND gate 217 by a signal that depends on the count of divide-by-eight counter 155.

Divide-by-eight counter 155 counts the trigger pulses coming in over lead 140″, and transmits, in binary code, the count on its first, second, and third stage outputs, labeled A,B,C respectively. Gated signals from these outputs are transmitted to seven inputs of a nine channel multiplexer comprising an eight-channel multiplexer 215 in parallel with bilateral switch 216. The output from this nine channel multiplexer provides the enabling or inhibiting input for AND gate 217.

Selection between the nine inputs to the nine-channel multiplexer is made by means of a binary coded signal received from the speed control on leads 211,212,213, together with a digital signal on lead 214. When lead 214 has a low potential, the multiplexer output is coupled to one of the eight inputs of multiplexer 215. When lead 214 has a high potential, multiplexer 215 is switched off and bilateral switch 216 is switched on. This couples a potential +V to the input of gate 217, thus providing full engine output torque. The nine different counts of counter 155 give enabled or inhibited fuel injection as tabulated in FIG. 24.

Referring to FIG. 24, the first column lists nine possible counts from the speed control counter. The heading of the next eight columns gives the count of the inhibitor counter. In the body of the table, "1" represents a high output potential to enable fuel injection, while "0" represents a low output potential to inhibit fuel injection. The table shows whether injection is enabled or inhibited for each of nine counts of the speed control counter and for each of eight counts of the inhibitor counter.

The tenth column gives a Boolean algebraic symbol describing the gated outputs from the inhibition counter to the multiplexer inputs. The last column gives the average fraction of enabled fuel injections for each speed control count, including uninhibited injection from cylinder no. 3. From one control count to the next, the engine torque output changes in increments of about nine percent of full torque.

In addition to the full torque state of the speed control counter, there are eight partially inhibited states. By making small changes in the spacings of the engine timing elements 7'', 8'',16'',17'',18'',19'' of FIG. 26, rapid switches between adjacent states of the speed control counter can be forced. The effect is a doubling, tripling or quadrupling of the number of speed control states, without making any circuit changes. Thus each of the nine percent increments in enabled fraction, shown in FIG. 24, can be divided into two, three, or four smaller increments in torque output.

Referring again to FIG. 28, any count less than 16 on counter 189 or 199 will allow delay counter 160' to count and will provide a positive output to NAND gate 59'. However, NAND gate 59'' will be disabled until counter 160 has counted up to sixteen revolutions of the engine crankshaft. Thereafter, NAND gate 59' will be enabled and a negative signal will be transmitted on lead 210 for inhibition of cylinder no. 3. The delay of sixteen crankshaft revolutions is provided to allow cylinder no. 3 time to reburn most of the blowby gases from the other three cylinders.

The mechanism for this inhibition of cylinder no. 3 is indicated in FIG. 26. Referring to FIG. 26, a low potential on lead 210 inhibits AND gate 49'', blocking transmission of the fuel rationing pulse from rationing one-shot **20*b* to the fuel valve of cylinder no. 3**.

The fractional torque output for each of the ten speed control states is shown in FIG. 22. Referring to FIG. 22, the percentage of full torque output is plotted against the percentage increase of the actual stroke time over the nominal stroke time (which is set by the pedal control). The torque is increased in steps about one half the size of the torque steps of the second embodiment.

When my engine is idling at 600 RPM, the explosion developed torque may be less than one quarter of the full output torque, with the engine speed scarcely above 600 RPM and with cylinder no. 3 being inhibited a fraction of the time. If now an external load is suddenly imposed, the engine speed will drop below 600 RPM, producing a positive count on the speed control counters. This positive count is transmitted to the injection inhibitor, so that the developed torque immediately increases to sustain the increased external load. Before the engine speed has dropped to 400 RPM, the engine is developing full output torque. Thus the engine is characterized by a very strong resistance to stalling.

The torque output of this engine can be reduced if desired by throttling the air intake. Throttling of air intake is then accompanied by automatic reduction of each fuel ration, as in a conventional fuel injection system. By inhibiting injection in a fraction of the cylinder cycles, the engine's air intake need never be as heavily throttled as it is in conventional gasoline engines. It is this always-adequate air intake pressure which makes possible my engine's strong resistance to stalling.

In FIGS. 18 to 30, reference numbers represent commercial components as follows:

116,142,156,157,181,191 represent inverter CD4009A
59 represents NAND gate CD 4011A
120–125 represent NAND gate CD4068B
90,182–187,192–197,217 represent AND gate CD4081B
180 represents AND-OR select gate CD4019A
159 represents OR gate CD4072B
60 represents NOR gate CD4001A
150,155,160,158,189,199,203 represent binary counter CD4024A
145,190,200 represent multivibrator CD4098B
166–170, 216 represent bilateral switch CD4016A
215 represents multiplexer CD4051A

These integrated circuits are marketed by RCA.

My method of reducing atmospheric pollution during deceleration comprises (a) dividing the engine into first and second groups of (one or more) cylinders, (b) receiving air and fuel leaking past all the pistons into a common enclosure (c) reburning all the leaking air and fuel (blowby gases) in the second group of cylinders whose primary fuel supply by injectors or carburetor is continuously enabled. (d) During deceleration, the primary fuel supply to the first group of cylinders is the first to be completely inhibited.

Delay counter 160 in FIG. 20 (or 160' in FIG. 28) provides an interlock between the primary fuel supplies to the first and second group of cylinders, ensuring that the primary fuel supply to the second group of cylinders is completely enabled whenever the primary fuel to the first group of cylinders has been enabled during the current cycle or during several preceding cycles of the second group of cylinders.

This method of stepped cutoff during deceleration reduces pollution to a lower lever than the method disclosed in U.S Pat. No. 3,612,013, wherein, during deceleration, the primary fuel supplies to all cylinders are inhibited simultaneously. My method of delayed inhibition for the second group of cylinders is not restricted to engines which employ fractional inhibition in the first group of cylinders.

I claim:

1. An internal combustion engine having a special combustion chamber and a plurality of M ordinary combustion chambers, each combustion chamber being partly bounded by its movable piston, all the pistons being mechanically coupled to a common power output shaft, each combustion chamber having an air inlet port, exhaust port, and associated means for executing a series of combustion chamber cycles, each cycle including air intake, compression, expansion and exhaust, the engine having means for taking a ration of fuel in each of its combustion chamber cycles, a single enclosure receiving air and fuel leaking past the pistons from all of the combustion chambers, a duct connecting the enclosure to the air inlet port of the special combustion chamber and not to the ordinary combustion chambers, the duct conveying the air and fuel leaking from all of the combustion chambers to be reburned in the special combustion chamber only, torque control means, overriding the fuel taking means, for enabling the fuel ration in every cycle of the special combustion chamber and for partially inhibiting the fuel rations for the ordinary combustion chambers in a repetitive pattern of successive enabled and inhibited combustion chamber cycles, the period of repetition containing N cycles of each of the combustion chambers, of which P cycles of each ordinary combustion chamber have their fuel ration inhibited, where N is a plural integer, P is an integer greater than zero and smaller than N, the total number of inhibited cycles of all of the combustion chambers within the period of repetition being MP, the product of M and P.

2. An improved internal combustion engine having at least first and second combustion chambers, each combustion chamber being partially bounded by its movable piston, the two pistons coupled to a common power output shaft, each combustion chamber having an air inlet port, exhaust port, and associated means for executing a series of combustion chamber cycles, each chamber cycle including air intake, compression, expansion and exhaust, a primary fuel supply to the first combustion chamber, a primary fuel supply to the second combustion chamber, a single enclosure receiving air and fuel leaking past the pistons from both the first and second combustion chambers, a duct connecting the enclosure to the air inlet port of the second combustion chamber only and not to the first combustion chamber, the duct conveying the air and fuel leaking from the first and second combustion chambers to be reburned in the second combustion chamber only, the improvement comprising:

first means for enabling and inhibiting the primary fuel supply to the first combustion chamber separately from the second combustion chamber, second means for enabling and inhibiting the primary fuel supply to the second combustion chamber separately from the first combustion chamber, an interlock, coupled to the first and second enabling means for ensuring that the primary fuel supply to the second combustion chamber is completely enabled whenever the primary fuel supply to the first combustion chamber has been enabled during the current cycle or the immediately preceding cycle of the second combustion chamber.

* * * * *